US012655714B2

(12) United States Patent
Sommerfeld et al.

(10) Patent No.: US 12,655,714 B2
(45) Date of Patent: Jun. 16, 2026

(54) MELTABLE MATERIAL TO SEAL FLOW-BY PASSAGEWAYS

(71) Applicant: Cameron International Corporation, Houston, TX (US)

(72) Inventors: Kyle Sommerfeld, Houston, TX (US); Andrew Sanders, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 19/079,670

(22) Filed: Mar. 14, 2025

(65) Prior Publication Data

US 2025/0290385 A1 Sep. 18, 2025

Related U.S. Application Data

(60) Provisional application No. 63/565,585, filed on Mar. 15, 2024.

(51) Int. Cl.

| | |
|---|---|
| ***E21B 33/13*** | (2006.01) |
| ***E21B 33/05*** | (2006.01) |
| ***E21B 36/04*** | (2006.01) |

(52) U.S. Cl.

CPC ..... *E21B 33/13* (2013.01); *E21B 33/05* (2013.01); *E21B 36/04* (2013.01); *E21B 2200/01* (2020.05)

(58) Field of Classification Search

CPC ..... E21B 33/13; E21B 33/05; E21B 36/04; E21B 2200/01; E21B 33/03; E21B 33/04

See application file for complete search history.

(56) References Cited

U.S. PATENT DOCUMENTS

| | | | | |
|---|---|---|---|---|
| 3,913,670 | A * | 10/1975 | Ahlstone | E21B 33/043 166/182 |
| 2006/0144591 | A1* | 7/2006 | Gonzalez | E21B 29/10 166/57 |
| 2015/0101813 | A1* | 4/2015 | Zhao | E21B 36/00 166/302 |
| 2015/0211322 | A1* | 7/2015 | Lowry | E21B 36/008 166/57 |
| 2018/0094504 | A1* | 4/2018 | Hearn | A01H 5/10 |
| 2018/0274333 | A1* | 9/2018 | Gibb | E21B 33/13 |
| 2020/0182008 | A1* | 6/2020 | Carragher | E21B 33/04 |
| 2020/0381403 | A1 | 12/2020 | Hearn | |
| 2022/0018201 | A1* | 1/2022 | Bouldin | E21B 37/00 |
| 2023/0265741 | A1* | 8/2023 | Talapatra | E21B 33/138 166/58 |
| 2024/0141754 | A1* | 5/2024 | Mitchell | E21B 33/10 |

FOREIGN PATENT DOCUMENTS

| | | | | |
|---|---|---|---|---|
| CA | 2579116 C | * | 9/2011 | E21B 33/128 |
| WO | WO-0194741 A1 | * | 12/2001 | E21B 36/04 |

* cited by examiner

*Primary Examiner* — James G Sayre
(74) *Attorney, Agent, or Firm* — Kyle R. Miiller

(57) ABSTRACT

A wellhead includes a wellhead housing and a hanger configured to support a casing within the wellhead housing. The wellhead housing, the hanger, or both includes one or more passageways. A seal element is configured to transition from a solid state in a first configuration to a flowable state to flow into the one or more passageways and to transition from the flowable state to the solid state in a second configuration to seal the one or more passageways.

20 Claims, 6 Drawing Sheets

MELTABLE MATERIAL TO SEAL FLOW-BY PASSAGEWAYS

CROSS-REFERENCE TO RELATED APPLICATION

This application claims priority to and the benefit of U.S. Provisional Application Ser. No. 63/565,585, entitled "MELTABLE MATERIAL TO SEAL FLOW-BY PASSAGEWAYS" and filed Mar. 15, 2024, the disclosure of which is incorporated herein by reference in its entirety for all purposes.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are used as fuel to power vehicles, heat homes, and generate electricity. Once a desired natural resource is discovered below a surface of the earth, mineral extraction systems are often employed to access and extract the desired natural resource. The mineral extraction systems may be located onshore or offshore depending on the location of the desired natural resource. The mineral extraction systems generally include a wellhead through which the desired natural resource is extracted. The wellhead may include or be coupled to a wide variety of components, such as a tubing hanger that supports a tubing, a casing hanger that supports a casing, valves, fluid conduits, and the like.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In certain embodiments, a wellhead includes a wellhead housing and a hanger configured to support a casing within the wellhead housing. The wellhead housing, the hanger, or both includes one or more passageways. A seal element is configured to transition from a solid state in a first configuration to a flowable state to flow into the one or more passageways and to transition from the flowable state to the solid state in a second configuration to seal the one or more passageways.

In certain embodiments, a method of operating a wellhead includes running a hanger with a seal element in a solid state in a first configuration. The method also includes performing cementing operations using one or more passageways formed in the hanger, the wellhead, or both. The method further includes applying heat to the seal element to transition the seal element to a flowable state. The method further includes removing the heat from the seal element to transition the seal element to the solid state in a second configuration to seal the one or more passageways.

In certain embodiments, a seal assembly for a wellhead includes a hanger configured to support a casing and comprising one or more passageways. The seal assembly also includes a seal element configured to transition from a solid state in a first configuration to a flowable state to flow into the one or more passageways and to transition from the flowable state to the solid state in a second configuration to seal the one or more passageways.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain embodiments of the present disclosure generally relate to systems and methods that support efficient casing installation operations. More particularly, certain embodiments of the present disclosure include one or more passageways that are selectively sealed or isolated via a seal element, wherein the seal element includes a meltable material that enables the seal element to transition from a solid state in a first configuration to a flowable state (e.g., liquid state) to flow into the one or more passageways. Further, the seal element is configured to transition from the flowable state to the solid state in a second configuration to seal the one or more passageways. While certain embodiments described herein refer to one or more hanger passageways that are formed in or along a hanger, it should be appreciated that techniques described herein may be utilized to seal one or more housing passageways that are formed in or along a wellhead housing.

In certain embodiments, the systems and methods disclosed herein enable the seal element to run with the hanger into the wellhead housing (e.g., rather than running the hanger into the wellhead housing, then conducting cementing operations, and then running the seal element into the wellhead housing). Accordingly, the systems and methods disclosed herein may save time and associated costs during drilling operations. In certain embodiments, the seal element may be run separately from the hanger (e.g., subsequent to the hanger), which may allow for various configurations and structures.

Figure 1:
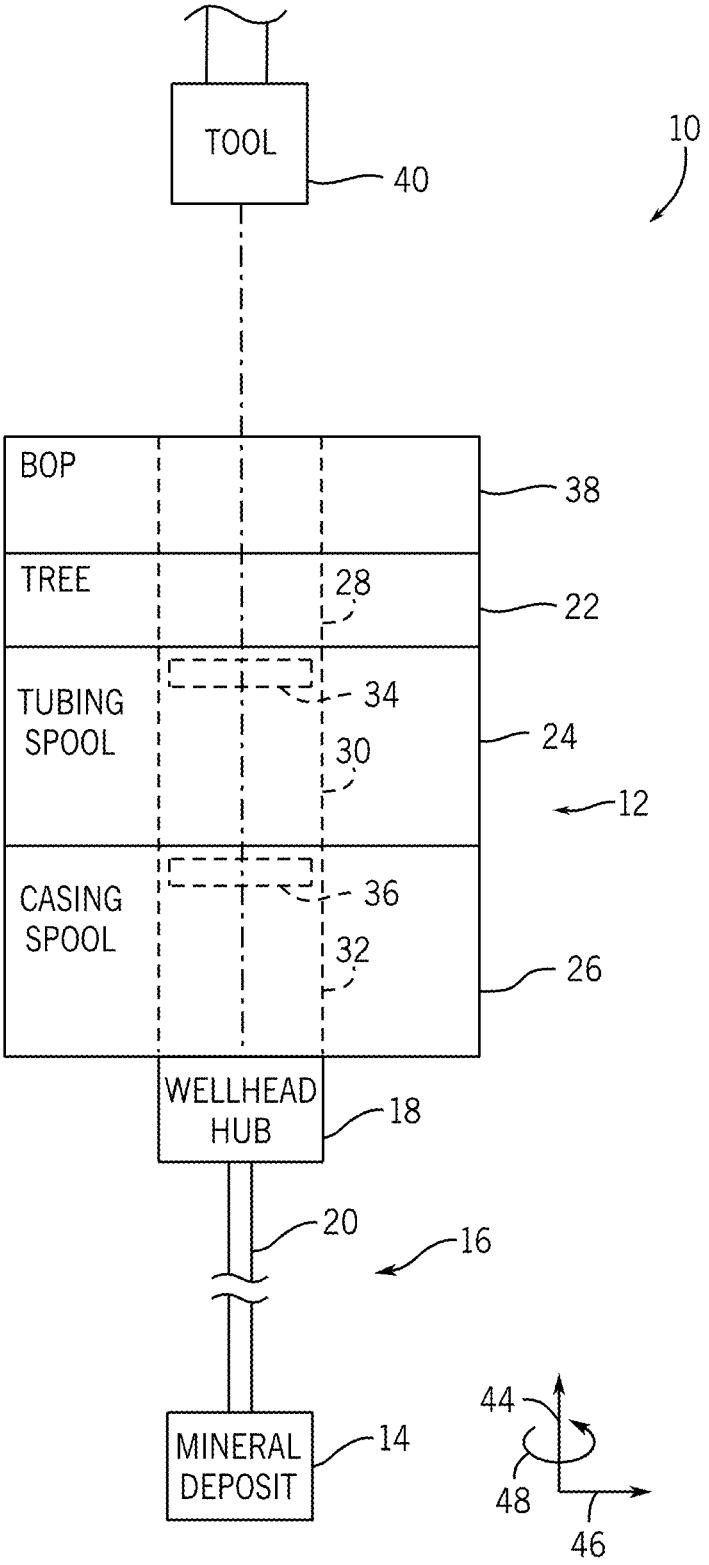
FIG. 1 is a block diagram of a mineral extraction system, in accordance with an embodiment of the present disclosure.

With the foregoing in mind, FIG. 1 is a block diagram of an embodiment of a mineral extraction system 10. The mineral extraction system 10 may be utilized to access and/or extract various natural resources (e.g., hydrocarbons, such as oil and/or natural gas) from the earth. As illustrated, the mineral extraction system 10 includes a wellhead 12 (e.g., annular wellhead) coupled to a mineral deposit 14 via a well 16. The well 16 may include a wellhead hub 18 (e.g., annular wellhead hub) and a wellbore 20. The wellhead hub 18 generally includes a large diameter hub disposed at an end of the wellbore 20 and is configured to connect the wellhead 12 to the wellbore 20. As will be appreciated, the wellbore 20 may contain elevated pressures. For example, the wellbore 20 may include pressures that exceed 10,000, 15,000, or even 20,000 pounds per square inch (psi). Accordingly, the mineral extraction system 10 may employ various mechanisms, such as seals, plugs, and valves, to control and regulate the well 16.

In the illustrated embodiment, the mineral extraction system 10 includes a tree 22, a tubing spool 24, a casing spool 26, and a blowout preventer (BOP) 38. The tree 22 generally includes a variety of flow paths (e.g., bores), valves, fittings, and controls for operating the well 16. Further, the tree 22 may provide fluid communication with the well 16. For example, the tree 22 includes a tree bore 28 that provides for completion and workover procedures, such as the insertion of tools (e.g., a tool 40) into the well 16, the injection of various chemicals into the well 16, and so forth. Further, the natural resources extracted from the well 16 may be regulated and routed via the tree 22. For example, the tree 22 may be coupled to a flowline that is tied back to other components, such as a manifold.

As shown, the tubing spool 24 may provide a base for the tree 22 and includes a tubing spool bore 30 that connects (e.g., enables fluid communication between) the tree bore 28 and the well 16. As shown, the casing spool 26 may be positioned between the tubing spool 24 and the wellhead hub 18 and includes a casing spool bore 32 that connects (e.g., enables fluid communication between) the tree bore 28 and the well 16. Thus, the tubing spool bore 30 and the casing spool bore 32 may provide access to the wellbore 20 for various completion and workover procedures. The BOP 38 may consist of a variety of valves, fittings, and controls to block oil, gas, or other fluid from exiting the well 16 in the event of an unintentional release of pressure or an overpressure condition.

As shown, a tubing hanger 34 is positioned within the tubing spool 24. The tubing hanger 34 may be configured to support tubing (e.g., a tubing string) that is suspended in the wellbore 20 and/or to provide a path for control lines, hydraulic control fluid, chemical injections, and so forth. Additionally, as shown, a casing hanger 36 is positioned within the casing spool 26. The casing hanger 36 may be configured to support casing (e.g., a casing string) that is suspended in the wellbore 20. The tool 40 may be utilized to lower the tubing hanger 34 into the tubing spool 24 and/or the casing hanger 36 into the casing spool 26.

As discussed in more detail herein, one or more hanger passageways may be formed in or along a hanger (e.g., the hanger 34, 36), and the one or more hanger passageways are selectively sealed via a seal element. To facilitate discussion, the mineral extraction system 10 and the components therein, may be described with reference to an axial axis or direction 44, a radial axis or direction 46, and a circumferential axis or direction 48.

Figure 2:
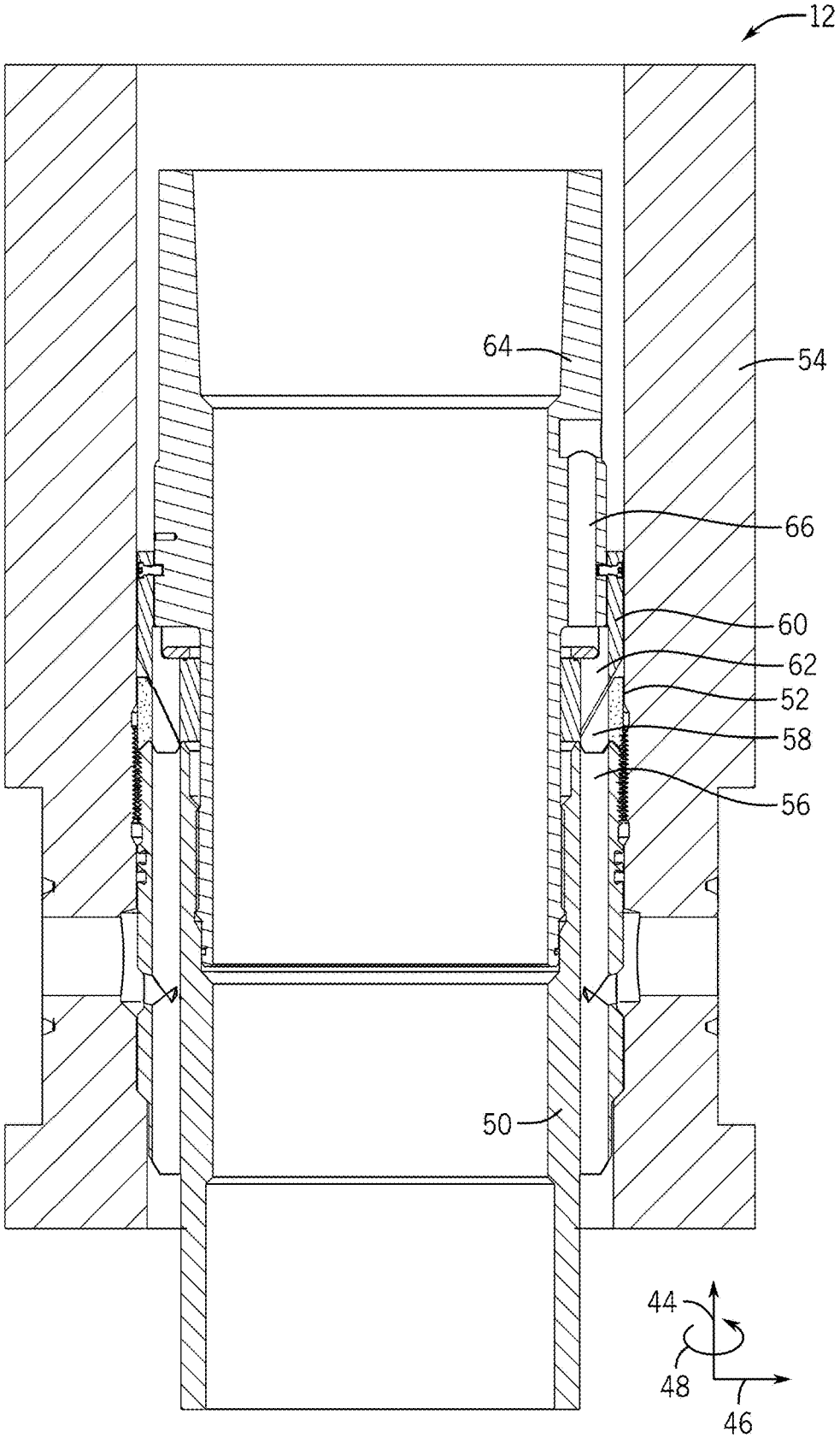
FIG. 2 is a cross-sectional side view of an embodiment of a portion of a hanger with a seal element that may be utilized in the mineral extraction system of FIG. 1, wherein the seal element is in a solid state and in a first configuration.

FIG. 2 is a cross-sectional side view of an embodiment of a portion of a hanger 50 (e.g., a casing hanger, such as the casing hanger 36 of FIG. 1) with a seal element 52. The hanger 50 and the seal element 52 are positioned in a wellhead housing 54 (e.g., a portion of a casing spool, such as a portion of the casing spool 26 of FIG. 1) of the wellhead 12.

The hanger 50 may include one or more hanger passageways 56. For example, as shown, the hanger 50 includes multiple hanger passageways 56 that extend along the axial axis 44 and that are distributed (e.g., spaced apart) about the circumferential axis 48. At a first time, such as prior to and/or during cementing operations, the seal element 52 is in a solid state and a first configuration to enable a flow of fluid (e.g., cement returns) through the one or more hanger passageways 56. For example, as shown, the seal element 52 is in the solid state and the first configuration that includes a ring shape (e.g., annular structure) that is axially stacked on the hanger 50. Further, the seal element 52 includes one or more seal element passageways 58 that extend along the axial axis 44 and that are distributed (e.g., spaced apart) about the circumferential axis 48 to align with the one or more hanger passageways 56. Thus, the flow of fluid may travel axially across the hanger 50 and the seal element 52 during the cementing operations.

Additionally, as shown, a support ring 60 may also include respective support ring passageways 62 and a running tool 64 may also include respective running tool passageways 66. The respective support ring passageways 62 and the respective running tool passageways 66 may also extend along the axial axis 44 and be distributed (e.g., spaced apart) about the circumferential axis 48 to align with the one or more hanger passageways 56. Thus, the flow of fluid may travel axially across the hanger 50, the seal element 52, the support ring 60, and the running tool 64 during the cementing operations. However, it should be appreciated that various configurations for the support ring 60 and/or the running tool 64 are envisioned. For example, the support ring 60 may be integrally formed with the running tool 64 and/or flow-by passageways for the flow of fluid may be provided in other locations to facilitate or to enable the flow of fluid during the cementing operations.

The seal element 52 includes a seal material that is configured to transition from the solid state in the first configuration to a flowable state (e.g., liquid state). For example, the seal material may be a meltable material, such as a meltable material with a low melting point, such as a meltable material configured to melt at temperatures above 260, 270, or 280 degrees Celsius. For example, the seal material may include Bismuth. The seal material may have a melting point that allows the seal element 52 to retain adequate structural strength during operations (e.g., to not melt during operations, such as running into the wellhead housing, during cementing operations, and so forth; under temperature and pressure conditions within the wellhead housing 54), to thereby not melt or deform in a manner or with timing that may impact performance.

The support ring 60 may include a support material that is configured to heat and to apply heat to the seal element 52. For example, the support material may include a heatable material, such as a heatable material that ignites due to application of heat or other ignition source. For example, the support material may include thermite. It should be appreciated that heat may be provided via any of a variety of techniques, such as via resistance to electrical current flowing through a heater wire (e.g., that may be placed in contact with and/or proximate to the support ring 60).

Figure 3:
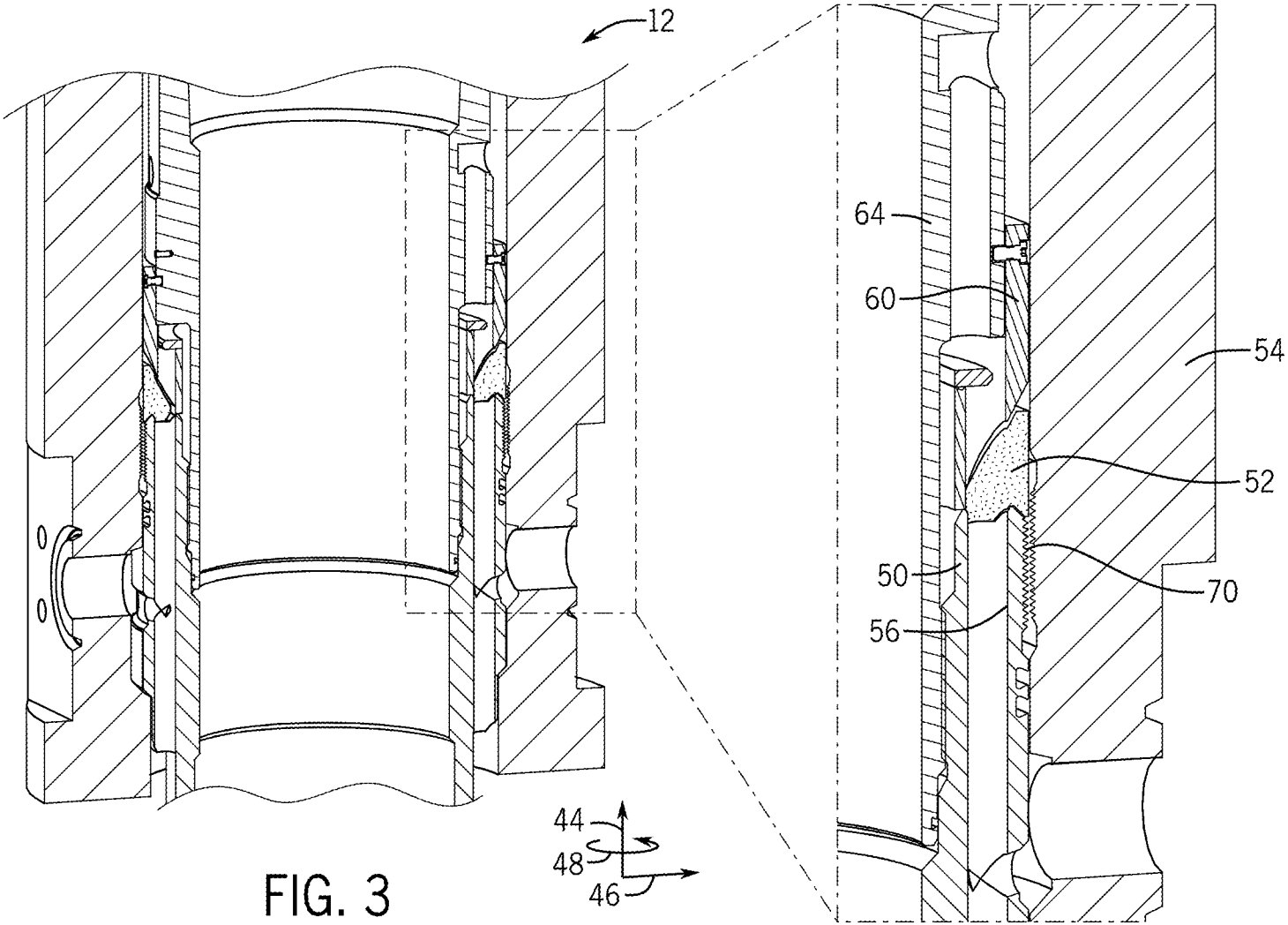
FIG. 3 is a cross-sectional side view of an embodiment of the portion of the hanger with the seal element of FIG. 2, wherein the seal element is in a flowable state.

FIG. 3 is a cross-sectional side view of an embodiment of the portion of the hanger 50 with the seal element 52. The hanger 50 and the seal element 52 are positioned in the wellhead housing 54 of the wellhead 12. As shown, the seal element 52 is in a flowable state to flow into the one or more hanger passageways 56 of the hanger 50.

At a second time, such as after the cementing operations, the support ring 60 applies heat to the seal element 52. The heat causes the seal element 52 to transition from the solid state and the first configuration to the flowable state to flow into the one or more hanger passageways 56 of the hanger 50. In certain embodiments, the seal element 52 in the flowable state may also flow into an annular space 70 defined between the hanger 50 and the wellhead housing 54.

Figure 4:
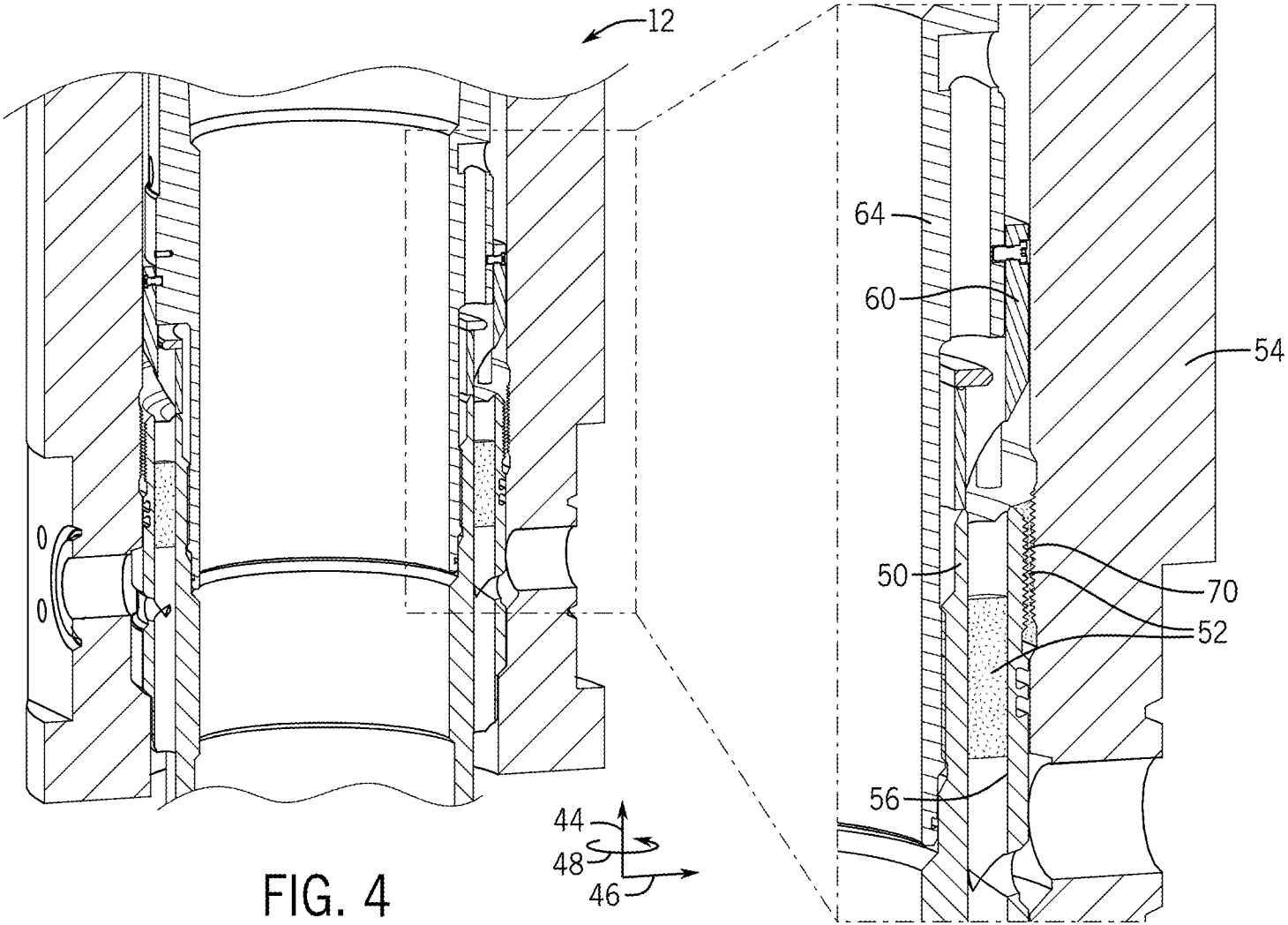
FIG. 4 is a cross-sectional side view of an embodiment of the portion of the hanger with the seal element of FIG. 2, wherein the seal element is in the solid state in a second configuration.

FIG. 4 is a cross-sectional side view of an embodiment of the portion of the hanger 50 with the seal element 52. The hanger 50 and the seal element 52 are positioned in the wellhead housing 54 of the wellhead 12. As shown, the seal element 52 is in the solid state in a second configuration within the one or more hanger passageways 56 of the hanger 50.

The seal element 52 may transition from the flowable state to the solid state in the second configuration due to a limited heated time (e.g., limited burn time) of the support ring 60 and/or due to the seal element 52 moving away from the support ring 60 (e.g., moving axially toward the wellbore). Thus, once the heat is removed from the seal element 52 (e.g., return to a temperature below the melting point of the seal material), the seal element 52 returns to the solid state and takes a form of the one or more hanger passageways 56 of the hanger 50 (e.g., fills the one or more hanger passageways 56 of the hanger 50). In this way, the seal element 52 blocks or seals the one or more hanger passageways 56 of the hanger 50. As noted herein, in certain embodiments, the seal element 52 may also block or seal the annular space 70 defined between the hanger 50 and the wellhead housing 54, and/or the seal element 52 may also provide engagement between the hanger 50 and the wellhead housing 54 across the annular space 70. Further, the seal element 52 may lock (e.g., retain) the hanger 50 within the wellhead housing 54.

Figure 5:
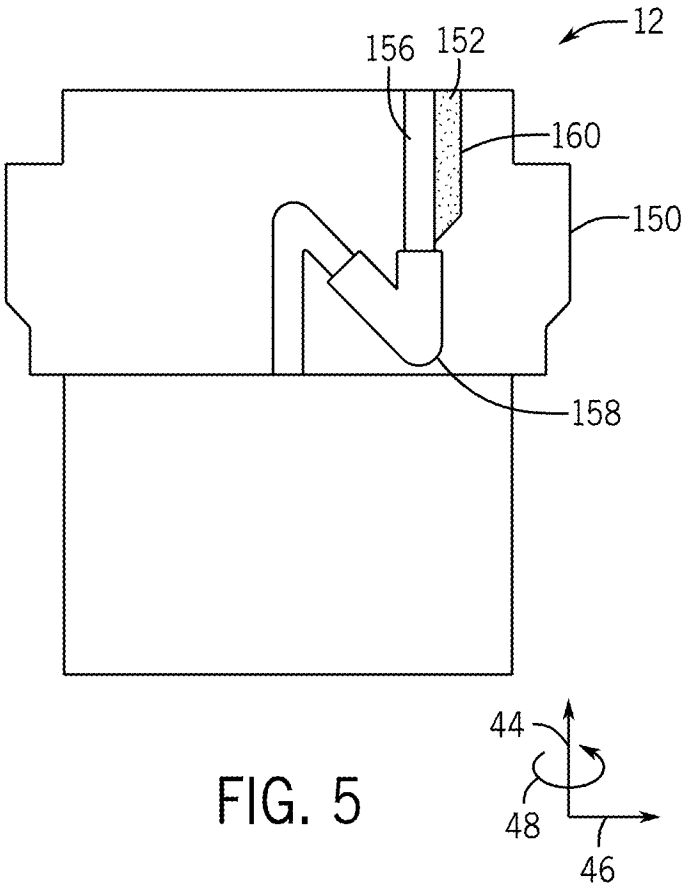
FIG. 5 is a schematic side view of an embodiment of a portion of a hanger with a seal element that may be utilized in the mineral extraction system of FIG. 1, wherein the seal element is in a solid state and in a first configuration.

FIG. 5 is a schematic side view of an embodiment of a portion of a hanger 150 (e.g., a casing hanger, such as the casing hanger 36 of FIG. 1) with a seal element 152. The hanger 150 and the seal element 152 are configured to be positioned in a wellhead housing (e.g., a portion of a casing spool, such as a portion of the casing spool 26 of FIG. 1) of the wellhead 12 of FIG. 1.

The hanger 150 may include one or more hanger passageways 156. For example, as shown, the hanger 150 includes the one or more hanger passageways 156 that each provide flow-by for a flow of fluid across the hanger 150 in the axial direction 44 and that also include a wavy shape (e.g., zig zag shape) in the circumferential direction 48. For example, the one or more hanger passageways 156 may each include or form a cup portion 158 (e.g., retainer portion; bend portion).

At a first time, such as prior to and/or during cementing operations, the seal element 152 is in a solid state and a first configuration to enable a flow of fluid (e.g., cement returns) through the one or more hanger passageways 156. For example, as shown, the seal element 152 is in the solid state and the first configuration that includes an axially-extending shape in a corresponding groove 160 along the hanger 150. Thus, the flow of fluid may travel axially across the hanger 150 and the seal element 152 during the cementing operations.

Figure 6:
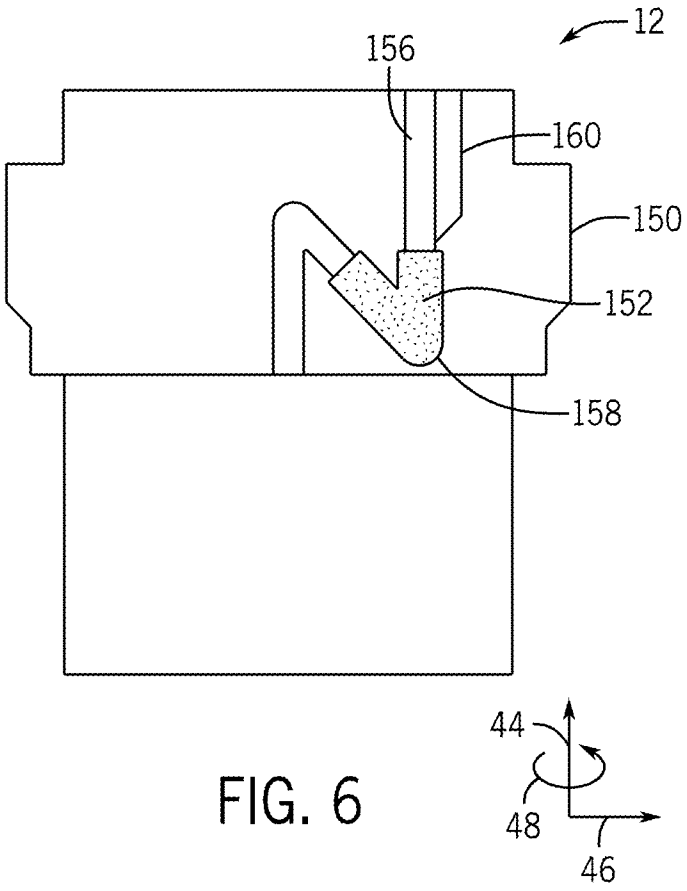
FIG. 6 is a schematic side view of an embodiment of the portion of the hanger with the seal element of FIG. 5, wherein the seal element is in the solid state in a second configuration.

FIG. 6 is a cross-sectional side view of an embodiment of the portion of the hanger 150 with the seal element 152. As shown, the seal element 152 is in the solid state in a second configuration within the one or more hanger passageways 156 of the hanger 150.

At a second time, such as after the cementing operations, application of heat causes the seal element 152 to transition from the solid state and the first configuration to a flowable state (e.g., liquid state) to flow into the one or more hanger passageways 156 of the hanger 150. In particular, the seal element 152 may flow into and be held (e.g., retained) in the cup portion 158 of the one or more hanger passageways 156 of the hanger 150 (e.g., due to a shape of the cup portion 158). As described herein, the seal element 152 includes the seal material that is configured to transition from the solid state in the first configuration to the flowable state.

At some time thereafter, the seal element 152 may transition from the flowable state to the solid state in the second configuration due to a limited heated time (e.g., limited burn time) and/or due to the seal element 152 moving away from a source of the heat. Thus, once the heat is removed from the seal element 152 (e.g., return to a temperature below the melting point of the seal material), the seal element 152 returns to the solid state and takes a form of the cup portion 158 of the one or more hanger passageways 156 of the hanger 150 (e.g., fills the cup portion 158 of the one or more hanger passageways 156 of the hanger 150). In this way, the seal element 152 blocks or seals the one or more hanger passageways 156 of the hanger 150.

Figure 7:
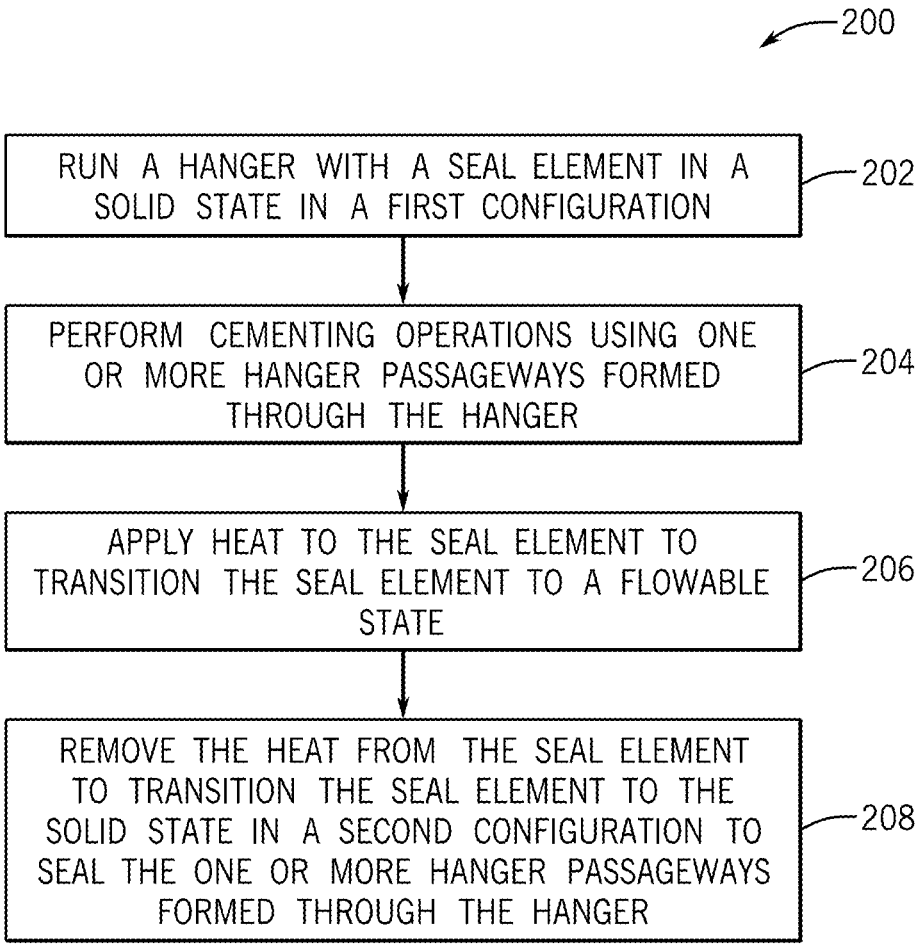
FIG. 7 is a flow diagram of an embodiment of a method of operating a wellhead to efficiently route fluid through a passage of a wellhead housing and/or a hanger and to seal the hanger in the wellhead housing.

FIG. 7 is a flow diagram of an embodiment of a method 200 of operating a wellhead to efficiently route fluid through one or more hanger passageways of a hanger and to seal the hanger in a wellhead housing. The method 200 disclosed herein includes various steps represented by blocks. It should be noted that at least some steps of the method 200 may be performed as an automated procedure by a system, such as an electronic control system for the wellhead. Indeed, the method 200 and/or other steps described herein may be monitored electronically (e.g., digitally) using any of a variety of suitable measurement devices (e.g., sensors; processing circuitry) to verify proper execution. Although the flow chart illustrates the steps in a certain sequence, it should be understood that the steps may be performed in any suitable order and certain steps may be carried out simultaneously, where appropriate.

In block 202, the method 200 may begin with running a hanger with a seal element that is in a solid state in a first configuration. In block 204, the method 200 may continue with performing cementing operations using one or more hanger passageways formed through the hanger (e.g., for flow-by of cement returns). In block 206, the method 200 may continue with applying heat to the seal element to transition the seal element to a flowable state (e.g., liquid state) to enable the seal element to flow into the one or more hanger passageways formed through the hanger. In block 208, the method 200 may continue with removing the heat from the seal element to transition the seal element to the solid state in a second configuration to seal the one or more hanger passageways formed through the hanger. It should be appreciated that, in the flowable state, the seal element may flow into an annular space between the hanger and a wellhead housing. Further, upon removing the heat from the seal element, the seal element may transition to the solid state in the second configuration to seal the annular space and/or lock (e.g., retain) the hanger within the wellhead housing. In this way, the seal element may form and/or act as a lock (e.g., retaining device) to lock the hanger within the wellhead housing.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the invention as defined by the following appended claims. For example, while the illustrated embodiments show a hanger and a housing of a wellhead, it should be understood that the systems and methods may be adapted to for use with any of a variety of other structures (e.g., annular structures). Additionally, any features shown or described with reference to FIGS. 1-7 may be combined in any suitable manner.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A wellhead, comprising:

a wellhead housing;

a hanger positioned within the wellhead housing and configured to support a casing suspended within a wellbore, the hanger extending around a periphery of the wellbore;

one or more passageways positioned within a body of the hanger, the one or more passageways providing fluid flow between portions of the body;

a seal element configured to transition from a solid state in a first configuration to a flowable state to flow into the one or more passageways and to transition from the flowable state to the solid state in a second configuration to seal the one or more passageways; and a cup-shaped portion positioned within the one or more passageways, the cup-shaped portion facilitating accumulation of the seal element in the flowable state to provide a location at which the seal element seals the one or more passageways in the solid state.

2. The wellhead of claim 1, wherein the seal element in the flowable state is configured to flow into an annular space between the wellhead housing and the hanger and to transition from the flowable state to the solid state in the second configuration to seal the annular space.

3. The wellhead of claim 1, wherein the seal element in the solid state in the second configuration is configured to lock the hanger in the wellhead housing.

4. The wellhead of claim 1, comprising a running tool, wherein the hanger and the seal element are coupled to one another to enable the running tool to run the hanger and the seal element together into the wellhead housing.

5. The wellhead of claim 1, wherein the one or more passageways are formed in the hanger, and the one or more passageways comprise multiple passageways spaced apart about a circumferential axis of the hanger.

6. The wellhead of claim 1, wherein the seal element in the solid state in the first configuration is configured to enable cement returns to travel axially across the seal element via the one or more passageways.

7. The wellhead of claim 1, wherein the seal element in the solid state in the first configuration comprises an annular shape that is axially stacked on the hanger.

8. The wellhead of claim 1, wherein the seal element comprises a material with a melting point of at least 260 degrees Celsius.

9. The wellhead of claim 1, wherein the seal element comprises bismuth.

10. The wellhead of claim 1, further comprising a support ring configured to apply heat to the seal element.

11. The wellhead of claim 10, wherein the support ring is configured to ignite in response to application of heat to the support ring.

12. The wellhead of claim 1, wherein the one or more passageways each comprise a wavy shape in a circumferential direction, and the wavy shape forms the cup-shaped portion.

13. The wellhead of claim 1, wherein the seal element, in the flowable state, flows along the hanger into the wellhead housing, and further wherein the seal element, in the solid state, locks the hanger within the wellhead housing, wherein the seal element comprises a seal material that does not melt under pressure and temperature conditions within the wellhead housing, wherein the wellhead further comprises a support ring having a support ring passageway, the support ring comprising a support ring material that is ignitable in response to application of heat, and wherein the one or more passageways comprise a shape having a wavy profile with respect to a circumferential direction, and a lower portion of the shape forms the cup-shaped portion.

14. A method of operating a wellhead, the method comprising:

running a hanger with a seal element in a solid state in a first configuration, the hanger extending around a periphery of a wellbore;

performing cementing operations using one or more passageways, wherein the one or more passageways are positioned within a body of the hanger, the one or more passageways providing fluid flow between portions of the body, and wherein the one or more passageways further comprise a cup-shaped portion positioned within the one or more passageways;

applying heat to the seal element to transition the seal element to a flowable state;

flowing the seal element into the cup-shaped portion at which the seal element accumulates while in the flowable state, the cup-shaped portion positioned in at least one of the one or more passageways; and removing the heat from the seal element to transition the seal element to the solid state in a second configuration to seal the one or more passageways.

15. The method of claim 14, wherein running the hanger with the seal element comprises running the hanger with the seal element axially stacked on the hanger.

16. The method of claim 14, wherein applying heat to the seal element comprises heating a support ring positioned within the wellhead.

17. The method of claim 16, wherein removing the heat from the seal element is achieved due to a limited burn time of the support ring, the seal element in the flowable state moving away from the support ring, or both.

18. A seal assembly for a wellhead, the seal assembly comprising:

a hanger extending around a periphery of a wellbore and configured to support a casing suspended within the wellbore, the hanger comprising one or more passageways positioned within a body of the hanger, the one or more passageways providing fluid flow between portions of the body;

a seal element configured to transition from a solid state in a first configuration to a flowable state to flow into the one or more passageways and to transition from the flowable state to the solid state in a second configuration to seal the one or more passageways; and a cup-shaped portion positioned within the one or more passageways, the cup-shaped portion facilitating accumulation of the seal element in the flowable state to provide a location at which the seal element seals the one or more passageways in the solid state.

19. The seal assembly of claim 18, wherein the seal element in the flowable state is configured to flow into an annular space between a wellhead housing and the hanger and to transition from the flowable state to the solid state in the second configuration to seal the annular space.

20. The seal assembly of claim 18, further comprising a support ring configured to apply heat to the seal element.

* * * * *